US005471177A

United States Patent [19]

Hudspeth et al.

[11] Patent Number: 5,471,177

[45] Date of Patent: Nov. 28, 1995

[54] OCTAVE BAND GAP DIPLEXER

[75] Inventors: Thomas Hudspeth, Malibu; Fritz Steinberg, Culver City, both of Calif.

[73] Assignee: Hughes Aircraft Company, Los Angeles, Calif.

[21] Appl. No.: 286,034

[22] Filed: Jul. 29, 1994

[51] Int. Cl.[6] ..... H01P 1/213

[52] U.S. Cl. ..... 333/126; 333/135

[58] Field of Search ..... 333/110, 126, 333/129, 134, 135

[56] References Cited

U.S. PATENT DOCUMENTS

| | | | |
|---|---|---|---|
| 2,879,484 | 3/1959 | Miller | 333/110 |
| 5,276,456 | 1/1994 | Kim | 333/126 X |

OTHER PUBLICATIONS

Harkless, *A Network for Combining Radio Systems at 4, 6 and 11 KMC,* Bell System Tech. Jrnl., Sept. 1959, vol. 38, No. 5, pp. 1253–1267.

*Primary Examiner*—Paul Gensler
*Attorney, Agent, or Firm*—Terje Gudmestad; W. K. Denson-Low

[57] ABSTRACT

A diplexer (14) has a first rectangular waveguide (38) extending from a front port (16) to a back wall (70), the back wall having a rectangular opening (72) therein constituting a section of a second rectangular waveguide (20) and serving as a back port (18) of the diplexer. A first spectral region of electromagnetic power communicates between the front port and a side port (28), and a second spectral region of electromagnetic power communicates between the front port and the back port. A center frequency of the second spectral region is greater than a center frequency of the first spectral region by a factor greater than or equal approximately to two. The side port includes an aperture (126) disposed in a sidewall (42) of the first waveguide, a third waveguide (32), and a coupling element (128) extending from the third waveguide through the aperture into the first waveguide for coupling electromagnetic power at the first spectral region between the first and the third waveguides. Coupled resonators (112, 124) disposed within the third waveguide provide a bandpass filter characteristic at the first spectral region, and inhibit propagation of electromagnetic power at the second spectral region between the first and the second waveguides. Within the inner conductor are two spaced apart cylindrical elements (100, 112) constituting plates of a capacitor (102).

19 Claims, 5 Drawing Sheets

OCTAVE BAND GAP DIPLEXER

BACKGROUND OF THE INVENTION

This invention relates to diplexers for separating electromagnetic signals at different spectral regions from a common port of the diplexer as well as for combining the signals at the common port and, more particularly, for operation as a multiplexer of signals disposed in spectral regions two of which are separated by at least approximately one octave in frequency and wherein the signals have a common polarization.

Diplexers are frequently used in communication systems for separating two signal channels, such as a received signal channel and a transmitted signal channel, wherein the two channels differ in frequency but are sufficiently close in frequency to fall within the same region of the electromagnetic spectrum. For example, the two channels may carry C-band signals, approximately 5 GHz (gigahertz), or two X-band signals, approximately 10 GHz. A typical situation for a diplexer is the connection of a single antenna to a transmitter and a receiver operating at different frequencies. Generally, the operation of a diplexer is reciprocal so that the diplexer can be used also to combine two signal channels.

In satellite communications, a satellite may carry a number of receivers and transmitters for reception of up link signals and transmission of down link signals in the manner of a relay station. The up link and the down link signals differ in frequency. Often a transmitter and a receiver share a common antenna, with connection to the antenna being made by means of a diplexer. A situation of considerable interest arises when it is desirable to employ a common antenna or communication link not only with signal channels in a first portion of the spectrum, but also with a further signal channel lying in a second portion of the spectrum differing in frequency from the first portion by an octave or more. A case in point is the situation wherein it is desired to employ both Ku band and C band signals with a common antenna. A problem arises in that a diplexer suitable for accomplishing the foregoing multiplexing of signals has not been available.

SUMMARY OF THE INVENTION

The aforementioned problem is overcome and other advantages are provided by a diplexer having a front port and a back port and a side port for communicating a first spectral region of electromagnetic power between the front port and the side port and a second spectral region of electromagnetic power between the front port and the back port. A center frequency of the second spectral region is greater than a center frequency of the first spectral region by a factor greater than or equal approximately to two. As an example in the use of a multiplexing system including the diplexer of the invention to separate plural signal channels in a satellite communication system, it is assumed that a C-band signal at a nominal frequency of 6 GHz is received by an antenna, that concurrently with the C-band signal there is received via the same antenna a Ku-band signal at a nominal frequency of 14 GHz, and concurrently with the C-band signal there is also a transmission via the same antenna of a Ku-band signal at a nominal frequency of 12 GHz. The multiplexing is accomplished by use of two diplexers in tandem wherein a first of the diplexers is the diplexer of the invention which is connected to the antenna, and the second diplexer is a standard form of diplexer. The first diplexer strips off the received C-band signal and allows the second diplexer to process the Ku-band signals.

The diplexer of the invention has a first rectangular waveguide extending from the front port to a back wall, the back wall having a rectangular opening therein constituting a section of a second rectangular waveguide and serving as the back port of the diplexer. The side port includes an aperture disposed in a sidewall of the first waveguide, a third waveguide, and a coupling element extending from the third waveguide through the aperture into the first waveguide for coupling electromagnetic power at the first spectral region between the first and the third waveguides. Tuning resonators disposed within the third waveguide constitutes a bandpass filter which inhibits propagation of electromagnetic power at the second spectral region between the first and the third waveguides. Preferably, the third waveguide is constructed as a coaxial transmission line with inner and outer conductors having square cross section. The coupling element is in the form of a probe connecting with the inner, or center, conductor via tuning resonators which are constructed as parts of the center conductor.

BRIEF DESCRIPTION OF THE DRAWING

The aforementioned aspects and other features of the invention are explained in the following description, taken in connection with the accompanying drawing wherein.

Identically labeled elements appearing in different ones of the figures refer to the same element in the different figures.

DETAILED DESCRIPTION

Figure 1:
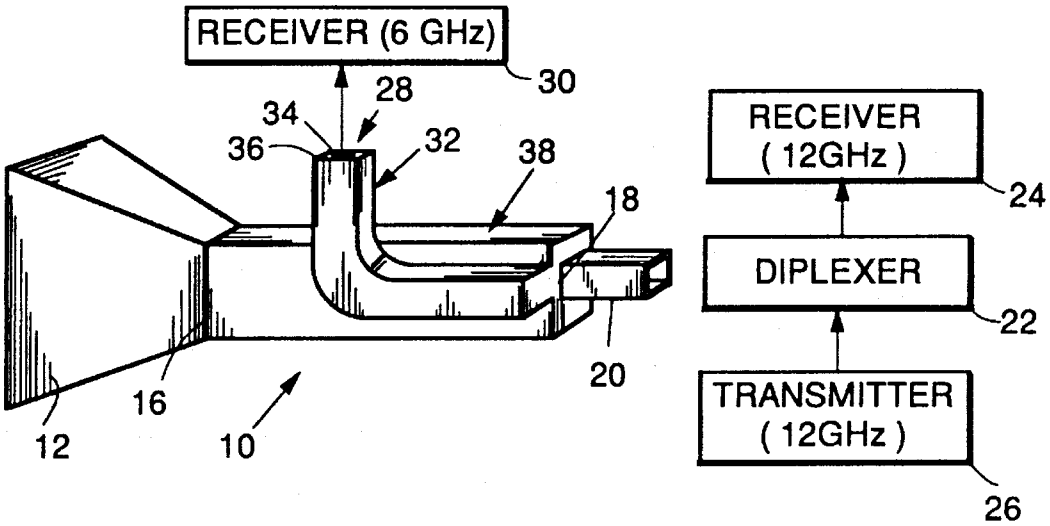
FIG. 1 shows a stylized view of a communication system including a standard form of diplexer and a diplexer constructed in accordance with the invention, portions of the figure being indicated diagrammatically.

With reference to FIG. 1, there is shown a communication system 10 for transmission and reception of radiant energy in a plurality of frequency bands. The system 10 includes an antenna in the form of a horn 12, the horn 12 being coupled to a diplexer 14 via a front port 16 of the diplexer 14. A back port 18 of the diplexer 14 is connected via a waveguide 20 to a further diplexer 22. The further diplexer 22 serves to connect a first receiver 24 and a transmitter 26 to the waveguide 20. A side port 28 of the diplexer 14 connects with a second receiver 30. The system 10 is readily carried by a satellite encircling the earth, and is useful for providing communication by satellite. As an example in the construction of a satellite communication system, the first receiver 24 would receive electromagnetic signals at Ku band at a nominal frequency of 14 GHz, more specifically in a frequency band of 14.315–14,495 GHz, and the transmitter 26 would transmit electromagnetic signals at Ku band at a nominal frequency of 12 GHz, more specifically in a frequency band of 12.567–12.747 GHz. These two Ku frequency bands can be handled by any of various forms of commercially available diplexers, the diplexer 22 being such a commercially available diplexer. However, in certain satellite communication situations, it is desirable to receive also a signal at a C-band frequency having a nominal value of 6 GHz, more specifically in a frequency band of 5.924 GHz–6.425 GHz, this being the operating band of the second receiver 30. While such additional communication at C band can be accomplished by use of a second antenna, it is desirable to minimize the physical size and weight associated with antennas on board a satellite by using a single antenna, such as the horn 12, for both the communications at the Ku and the C bands.

This object is accomplished by constructing the diplexer 14 in accordance with the present invention to enable coupling of both the Ku-band and the C-band signals, in the manner of a multiplexer, to the common antenna represented by the horn 12. The diplexer 14 is operative with the horn 12 at a common polarization for all of the foregoing communication channels, namely, the C-band reception channel, the Ku-band reception channel, and the Ku-band transmission channel. The waveguide 20 has a rectangular cross section, preferably size WR-75 measuring 0.750 inch wide by 0.375 high, and operable for a TE mode of propagation of electromagnetic waves. The side port 28 of the diplexer 14 comprises a coaxial waveguide 32 of square cross section, and having an inner conductor 34 and an outer conductor 36, and being operative with a TEM (transverse electromagnetic) wave. The C band communicated via the side port constitutes a first spectral region in the operation of the diplexer 14, and the Ku reception and transmission bands communicated via the back port 18 constitute a second spectral region in the operation of the diplexer 14. The invention of the diplexer 4 is described now in detail.

Figure 5:
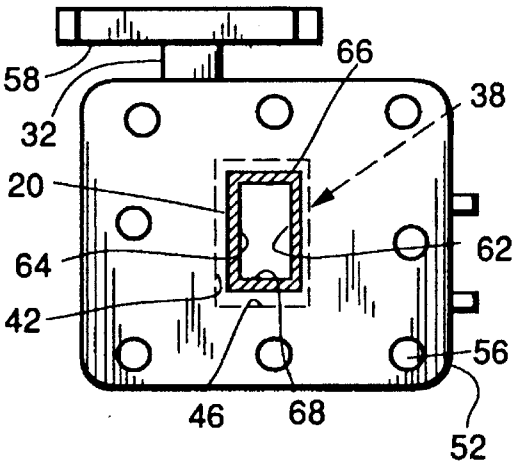
FIG. 5 is a transverse sectional view of the diplexer taken along the line 5—5 in FIG. 3.
Figure 4:
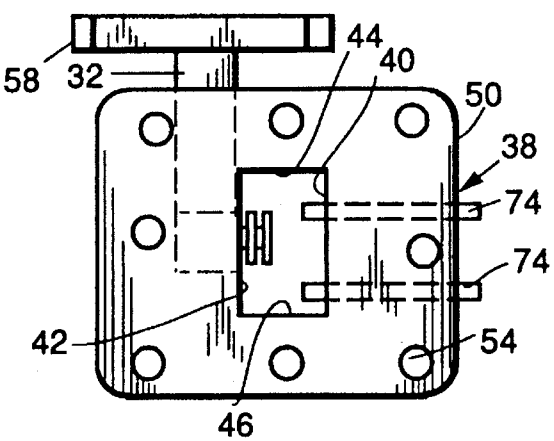
FIG. 4 is a view, transverse to a longitudinal axis of the inventive diplexer, taken along an interface between two waveguides as shown by the line 4—4 in FIG. 3.
Figure 2:
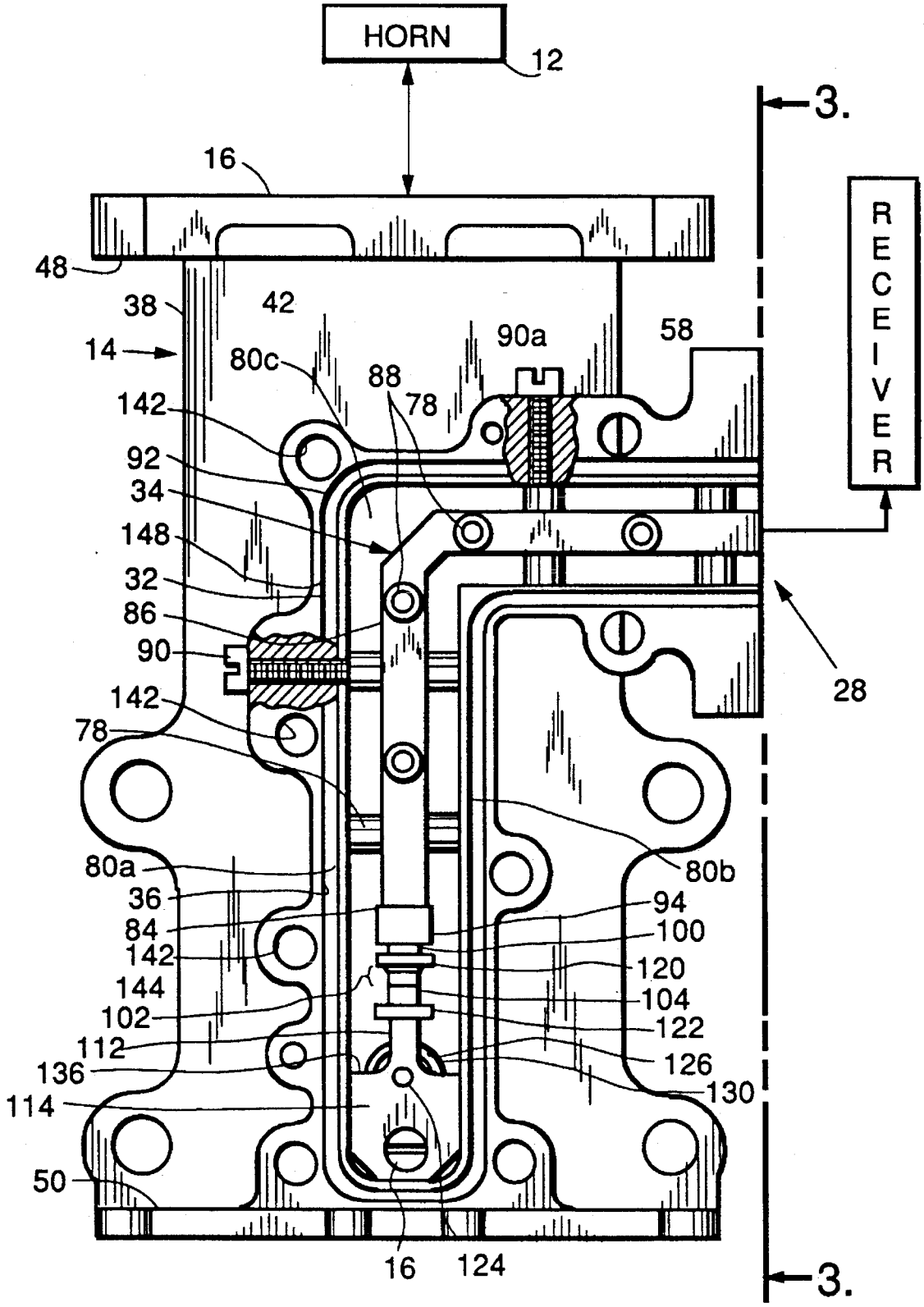
FIG. 2 shows a side view of the diplexer of the invention, wherein a cover of a side port coaxial waveguide has been removed to show details in construction of the side port waveguide.
Figure 3:
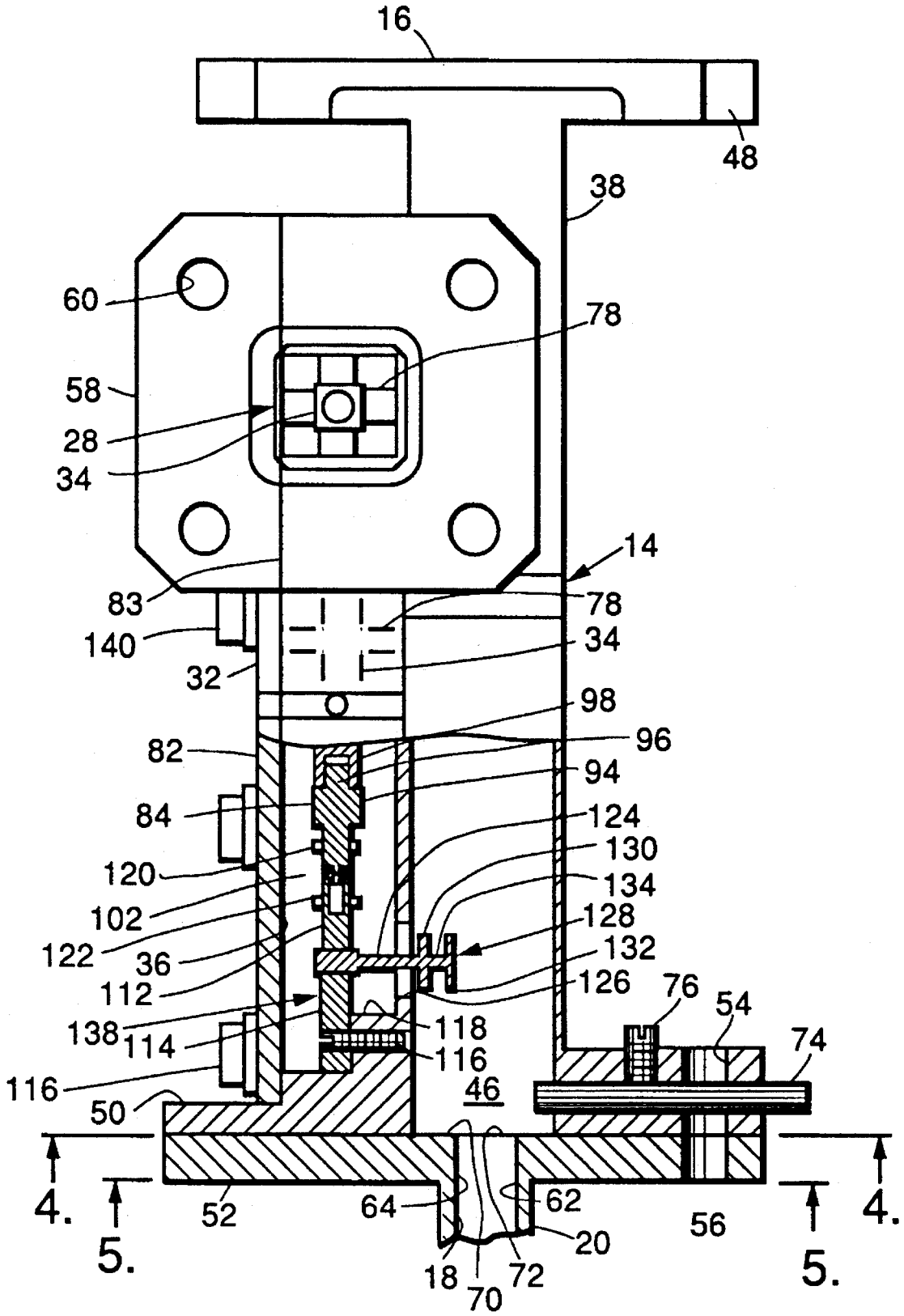
FIG. 3 is a plan view of the diplexer of the invention, partially sectioned, taken along the line 3—3 in FIG. 2.
Figure 6:
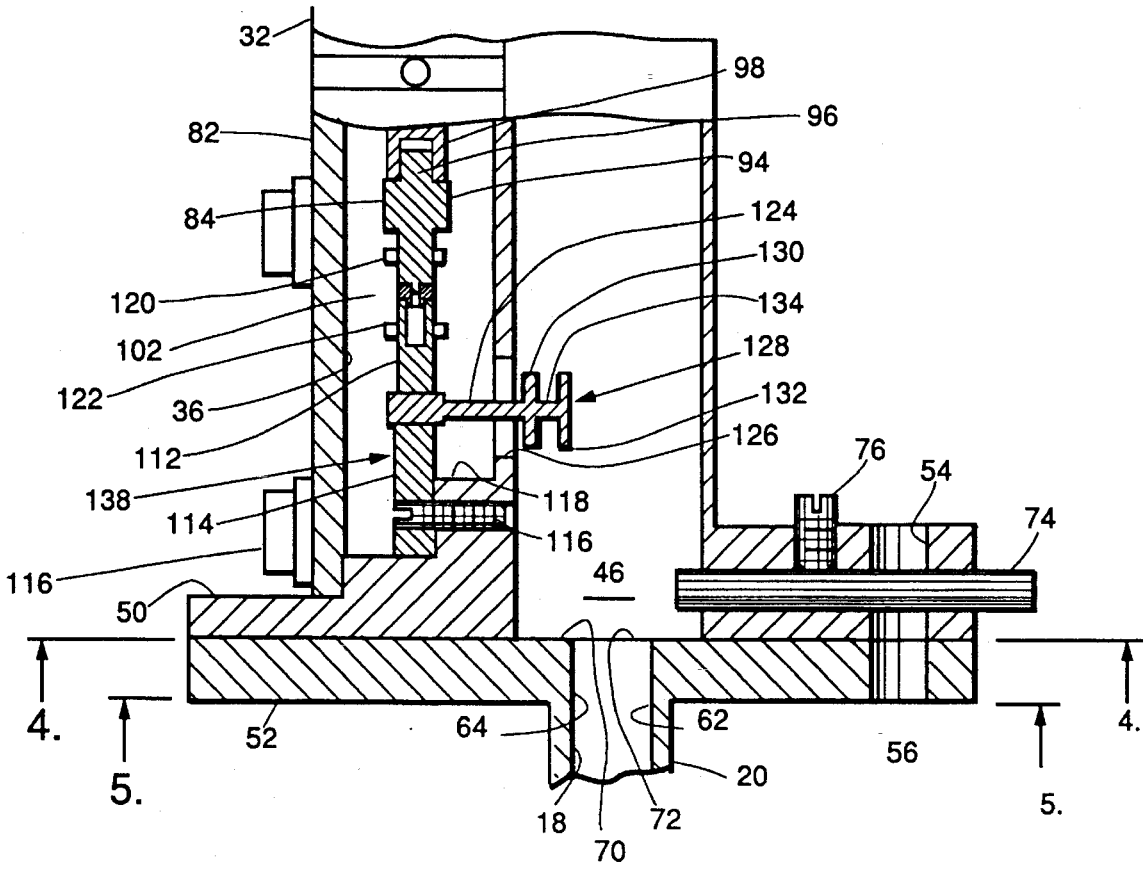
FIG. 6 is an enlarged fragmentary portion of FIG. 3 showing structure of a capacitor and resonators along an inner conductor of a coaxial transmission line.

With reference to FIGS. 2–6, the diplexer 14 comprises a section of rectangular waveguide 38 having a pair of opposed broad walls 40 and 42 joined together by a pair of opposed narrow walls 44 and 46. The waveguide 38 includes a front flange 48 by which the waveguide 38 is connected to the horn 12 or to such other waveguide (not shown) which may be employed in the communication system 10 (FIG. 1) for coupling the diplexer 14 to the horn 12. The waveguide 38 further comprises a back flange 50 disposed on an end of the waveguide 38 opposite the front flange 48. The back flange 50 serves to connect the waveguide 38 to the waveguide 20 via a flange 52 of the waveguide 20. In order to connect the flange 50 to the flange 52, holes 54 and 56 are provided respectively in the flanges 50 and 52 for receiving bolts (not shown) for securing the flanges 50 and 52 to each other in conventional fashion. The holes 54 and 56 are indicated in FIGS. 4 and 5, by way of example, it being understood that any number of holes in any desired configuration of the holes may be used in accordance with standard practice of joining waveguides. To simplify the drawing, only one of the holes 54 and only one of the holes 56 are shown in FIG. 3. The side-port waveguide 32 of the diplexer 14 is provided with a flange 58 which serves to make connection of the waveguide 32 to the receiver 30, or to such other waveguide (not shown) which may be employed for connection of the diplexer 14 to the receiver 30. The flange 58 is provided with holes 60 through which bolts (not shown) are inserted for connection to a corresponding flange (not shown) of the receiver 30 or of the foregoing interconnecting waveguide (not shown). The waveguide 20 also has a rectangular cross section and is composed of a pair of opposed broad walls 62 and 64 interconnected by a pair of opposed narrow walls 66 and 68.

In accordance with a feature of the invention, the cross-sectional dimensions of the waveguide 20 are smaller than the corresponding cross-sectional dimensions of the waveguide 38. This enables the flange 52 of the waveguide 20 to serve as a back wall 70 for the waveguide 38, and to function as a short circuit to C-band radiation within the waveguide 38. An opening 72 in the back wall 70 provides for communication of the Ku-band radiation between the waveguide 38 and 20. The aspect ratio of the cross-sectional dimensions of the waveguide 38 is selected to provide the desired characteristic impedance for the frequencies of the electromagnetic energy being handled. In the preferred embodiment of the invention, the waveguide 38 has an aspect ratio of 3 wherein each of the broad walls 40 and 42 has a width of 1.2 inches, and each of the narrow walls 44 and 46 has a height of 0.4 inches. The aspect ratio of the cross-sectional dimensions of the waveguide 20, given by the ratio of the width of the broad wall 62 or 64 to the height of the narrow wall 66 or 68, is approximately 2. Other configurations are possible.

With respect to the C-band signal in the waveguide 38, the back wall 70 acts as a reflector with a reflection coefficient equal essentially to unity and having a small inductive phase shift (less than approximately 10°). To facilitate coupling of the Ku-band radiation through the opening 72 in the back wall 70, two dielectric impedance matching rods 74 are supported within the flange 50, and are positioned spaced-apart from each other and in side-by-side relation. The rods 74 are made of a ceramic material such as alumina, and extend through the same broad wall, namely the broad wall 40, partway into the waveguide 38. As best seen in FIG. 3, the extension of a rod 74 into the waveguide 38 is approximately one-fifth of the height of the narrow wall 46. The amount of the extension for each of the rods 74 is adjusted experimentally to minimize the VSWR (voltage standing wave ratio) at the Ku band, and to maximize transmission of the Ku-band radiation. The rods 74 are secured in their respective positions by screws 76, one of which is shown in FIG. 3. Each screw 76 is mounted within the flange 50 and is made to press against its rod 74, for securing the rod 74, by rotation of the screw 76. The location of each of the rods 74 provides for a distance between each rod 74 and the back wall 70 which is substantially less than one-quarter wavelength (guide wavelength) of the Ku-band radiation within the waveguide 38. By way of example, the distance between a rod 74 and the back wall 70 is approximately one-eighth of the guide wavelength of the Ku-band radiation. The rods 74 are made of a dielectric material, such as alumina, having a dielectric constant of approximately 9. The rods 74 provide for capacitive susceptance to counteract the reflection introduced by the step (inductive susceptance) at the back wall 70.

In the side-port waveguide 32, the inner conductor 34 and the outer conductor 36 are provided each with a square cross-sectional configuration. The cross-sectional dimensions of the inner conductor 34 and the outer conductor 36 are chosen, in well-known fashion, to provide for a specific value of impedance, an impedance of 50 ohms being employed on the preferred embodiment of the invention. The width of an interior wall of the outer conductor 36 is 0.31 inches in a preferred embodiment of the invention. The inner conductor 34 is centered along a central axis of the outer conductor 36, and is held in this position, by means of spacers 78 of dielectric material. In view of the fact that the diplexer 14 is to be carried by a spacecraft, and will be exposed to sunlight, the various components of the diplexer 14 undergo substantial changes in temperature as the diplexer 14 is heated by rays of the sun, and then is cooled as the satellite passes into the shadow cast by the earth. Accordingly, the dielectric material of the spacers 78 should be operative at both high and low temperatures, and should also have relatively low loss for absorption of microwave energy so as to prevent significant attenuation of microwave signals propagating through waveguide 32. One such suitable dielectric material is manufactured by General Electric under the name of Ultem 1000, this material being a low loss material having a dielectric constant less than 3. Also, with respect to reducing the heating of the diplexer 14 from intense sunlight, it is preferable to construct the waveguides 32 and 38 of silver plated aluminum.

Figure 7:
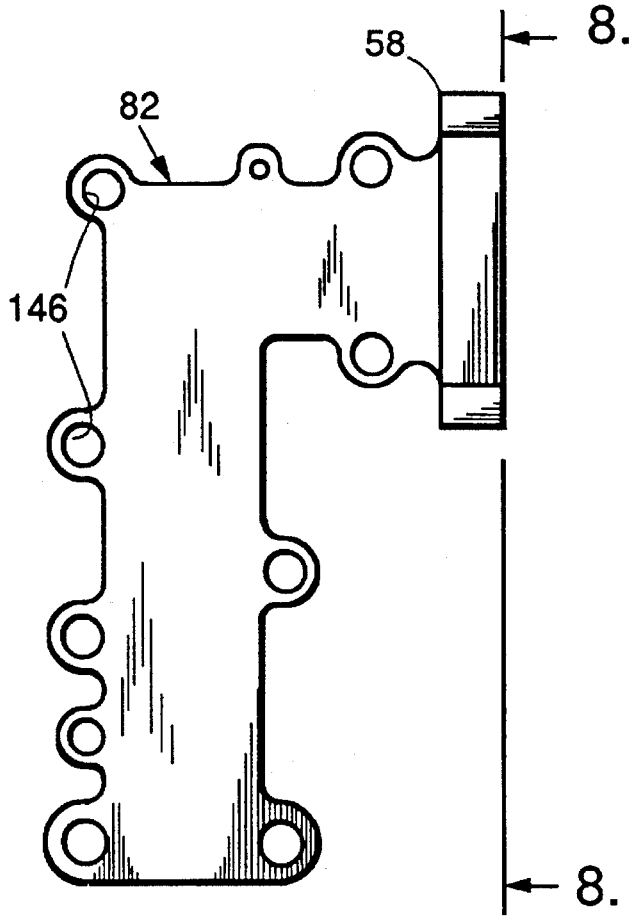
FIG. 7 is a plan view of a cover of of the diplexer.
Figure 8:
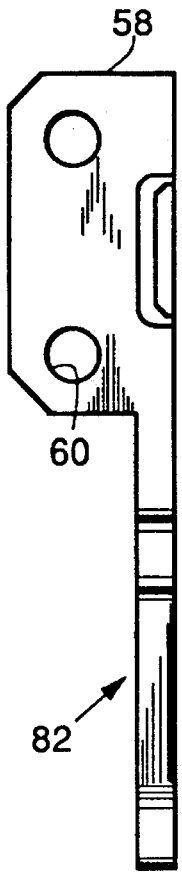
FIG. 8 is a side view of the cover, taken along the line 8—8 in FIG. 7.

The waveguide 32 includes sidewalls 80A and 80B which are formed as an integral mechanical assembly with the waveguide 38, this construction allowing a portion of the broad wall 42 to serve as a bottom wall 80C of the waveguide 32, the bottom wall 80C joining the two sidewalls 80A and 80B. A top wall of the waveguide 32 is formed as a cover 82 (shown in FIGS. 3, 7 and 8) which is secured to the sidewalls 80A and 80B along an interface 83 (FIG. 3) in a manner to be described hereinafter. As used herein, the term sidewall may refer to a narrow wall or a broad wall of any of the waveguides 20 and 38, and in the case of the square waveguide 32, to any of the walls including the cover 82, but excluding an end wall. The walls 80A, 80B and 80C, and the cover 82 constitute the outer conductor 36 of the waveguide 32. The portion of the inner conductor 34 extending from point 84 to the side port 28 is fabricated as a solid, substantially rigid rod 86. This provides for certain conveniences in assembling the waveguide 32. Thus, in accordance with a constructional feature of the invention, each of the spacers 78 is constructed as a hollow dielectric cylinder disposed upon a dielectric pin 88. Each of the pins 88 is mounted securely to the rod 86 and serves to locate a respective one of the spacers 78 which is slid on over the respective one of the pins 88. Each pin 88 extends only partway into its spacer 78. Metal screws 90, one of which is designated 90A, are mounted to the sidewall 80A to secure the spacers 78 between the sidewalls 80A and 80B of the waveguide 32.

The spacers 78 are mounted in the arrangement of opposed pairs of spacers 78 wherein, in any one pair of the spacers 78, the two spacers 78 of the pair are coaxial, and a corresponding one of the screws 90 is aligned with the common axis of the pair of the spacers 78. Upon a rotation of the screw 90, the screw 90 advances towards the pair of spacers 78 and squeezes the spacers 78 against the rod 86 and against the opposed sidewalls 80A and 80B of the waveguide 32. If desired, different sized spacers 78, or shims configured as the spacers 78, may be employed to provide for a fine adjustment of the position of the inner conductor 34. Also, it is noted that the pairs of spacers 78 are mounted in orthogonal planes wherein one plane is parallel to the broad wall 42 of the waveguide 38, and another plane is perpendicular to the broad wall 42. The spacers 78 disposed in the plane perpendicular to the broad wall 42 are held in position by the cover 82, as indicated in phantom in FIG. 3 for one of the pairs of the spacers 78. Furthermore, it is noted that the waveguide 32 has a right angle bend 92. Thus, the axes of the paired spacers 78 lie along three mutually perpendicular directions to provide for full adjustment of the location of the inner conductor 34.

The inner conductor 34 of the waveguide 32 further comprises an extension 94 secured to an end of the square rod 34, at point 84, to convert the square shape of the inner conductor 34 to a circular shape. The extension 94 is fabricated of an electrically conductive material, such as copper or aluminum, and is configured as a circular cylindrical section. The C-band radiation within the waveguide 32 has a wavelength of approximately two inches, and the axial length of the extension 94 is electrically short, in the range of approximately 0.1 to 0.2 wavelength. For connection of the extension 94 to the rod 34, it is convenient to provide the extension 94 with a threaded neck 96 which is secured within a threaded cylindrical recess 98 of the rod 34. The diameter of the extension 94 is equal approximately to a diagonal of the square rod 34. Opposite the neck 96, the extension 94 has a shaft 100 which extends along the axis of the extension 94, the shaft 100 having a cylindrical shape and having a diameter reduced from the size of the diameter of the extension 94. Preferably, the extension 94 with its neck 96 and its shaft 100 are formed integrally as a one-piece unit.

The lower end of shaft 100 serves as one electrode of a capacitor 102. A description of the construction of the capacitor 102 is provided with reference to FIG. 6, wherein the enlarged view facilitates a showing of the various components of the capacitor 102. The capacitor 102 comprises a bushing 104 of electrically insulating, dielectric material, preferably a plastic such as the aforementioned Ultem by way of example. The bushing 104 has a cylindrical front section 106 of enlarged diameter and a cylindrical back section 108 of reduced diameter. The shaft 100 of the extension 94 is provided with a pin 110 extending along the axis of the extension 94, and the bushing 104 is provided with a central bore 111 for receiving the pin 110. The front section 106 of the bushing 104 abuts the shaft 100 of the extension 94, and is guided into axial alignment with the shaft 100 by insertion of the pin 110 into the bore 111. A circular cylindrical metallic shaft 112 extends from and is integrally formed with a metallic, electrically conductive support plate 114. The shaft 112 is provided with a central bore 115 for receiving the back section 108 of the bushing 104, and thereby securing the bushing 104 to the shaft 112. The opposing end faces of the shafts 100 and 112, disposed on opposite surfaces of the bushing 104, serve as the electrodes of the capacitor 102. The material of the bushing 104 is selected to provide a desired amount of capacitance, the amount of the capacitance being dependent also on the area of each plate of the capacitor 102, as well as on the spacing between the plates.

The shaft 112 serves as a resonator in the microwave circuit. The diameters of the shafts 100 and 112, and the outer diameter of the front section 106 of the bushing 104 are equal in a preferred embodiment of the invention. The support plate 114 is secured by means of a screw 116 to an abutment 118 of the flange 50. The abutment 118 and the flange 50 are constructed preferably as an integral mechanical assembly with the waveguide 38. This structure, as shown in FIG. 2, enables the extension 94 and the bushing 104 to be held together between the rod 34 and the shaft 112 by tightening the screw 90A to force these components against the support plate 114. Two dielectric rings 120 and 122 are mounted on the shafts 100 and 112, respectively, and may be slid along the shafts 100 and 112, respectively, to desired positions for adjusting the capacitance of the capacitor 102 and for tuning the microwave circuit. In the preferred embodiment of the invention, the rings 120 and 122 are fabricated of a plastic material such as the aforementioned Ultem.

A metal shaft 124 is mounted upon the plate 114 and extends therefrom in a direction perpendicular to the shaft 112. The shaft 124 also serves as a resonator in the microwave circuit, and extends into the waveguide 38 via an aperture 126 in the broad wall 42. The outer end of the shaft 124, away from the plate 114, is formed as a probe 128 to establish a desired coupling between the waveguide 38 and the probe 128. The probe 128 comprises an inner disk 130 and an outer disk 132 which are spaced apart by a shaft section 134. In view of the right-angle bend between the shafts 112 and 124, the waveguide 32 can be oriented parallel to the waveguide 38, or disposed in a plane parallel to the waveguide 38, to provide for a compact configuration of the diplexer 14. Such a complex configuration is most useful in the construction of satellite borne microwave equipment. Also, it is noted that the bend 92 in the waveguide 32 is provided as a matter of convenience in producing a compact configuration of the diplexer 14. It is to be understood that the bend 92 is provided by way of example in the construction of the preferred embodiment of the diplexer 14, but may be bent in some other direction, or dispensed with altogether, if desired for connection of the diplexer 14 to some other microwave circuit.

The probe 128 is located in front of the back wall 70, and is spaced therefrom by a distance of approximately one-quarter guide wavelength of the C-band radiation in the waveguide 38. The disks 130 and 132 of the probe 128 are made of metal so as to be electrically conductive and, also, the shaft section 134 is similarly made of metal. In the construction of the probe 128, and in the connecting of the two shafts 112 and 124 to the plate 114, and in the securing of the plate 114 to the abutment 118, it is noted that the construction is accomplished in a manner which avoids any build-up of oxide, rust, dielectric material or other foreign matter between the probe 128 and the coaxial transmission line of the waveguide 32, thereby to prevent generation of intermodulation products derived from a combination of the frequencies of the various signal channels. This provides increased fidelity in the separation and/or combination of the various signal channels at 6, 12 and 14 GHz. By way of example, one such passive intermodulation product which is inhibited by the foregoing construction is a product at 14.320 GHz which is in the receive passband and is equal to the difference between the tenth harmonic of 12.745 GHz and the ninth harmonic of 12.570 GHz, two frequencies that may simultaneously occur in the transmit passband. It is noted that the foregoing construction of the diplexer 14 provides for reciprocal operation such that signals at any one of the foregoing frequencies can travel in either direction within the diplexer 14.

The microwave circuit includes a two-pole filter constituted by two resonators wherein the shaft 124 serves as one of the resonators and the shaft 112 serves as the second of the resonators. A coupling coefficient of the filter is attained by virtue of mutual inductance between the two resonators, the mutual inductance and the coupling coefficient being based on the location of a front edge 136 (shown in FIG. 2) of the support plate 114. Upon an increasing of the size of the plate 114 by advancing the front end 136 away from the waveguide flange 50, there is a decrease in the mutual inductance and in the coupling coefficient. However, upon a decrease in the size of the plate 114 by a retraction of the front edge 136 closer to the waveguide flange 50, there is an increase in the mutual inductance and the coupling coefficient. As a matter of convenience in manufacture of the diplexer 14, the plate 114 may be constructed initially slightly oversized. Thereupon, during a tuning of the filter, the front edge 136 may be retracted by shaving off material of the plate 114 to provide the desired filter characteristic which is maximally flat across the passband.

The disks 130 and 132 of the probe 128 serve to tune the probe to a desired frequency, a resonant frequency of the probe and the coupling of the probe to waveguide 38 depending on the diameters of the two disks and the spacing between the two disks as is well known in the fabrication of probes. Sliding of the rings 120 and 122 provide for adjustment in the capacitance of the capacitor 102 such that a sliding of either or both of the rings 120 and 122 towards the bushing 104 increases capacitance of the capacitor 102, while a distancing of one or both of the rings 120 and 122 from the bushing 104 results in a decrease of the capacitance. Furthermore, a sliding of the ring 122 on the shaft 112 away from the bushing 104 is effective to raise the resonant frequency of the resonator of the shaft 112.

In accordance with a feature of the invention, the foregoing 6 GHz two-pole bandpass filter, shown generally at 138 in FIG. 3, is also employed to inhibit entry of the Ku-band radiation at the 12 GHz and the 14 GHz frequencies into the side-port waveguide 32 from the waveguide 38. This is accomplished because the physical dimensions of the shafts 112 and 124 form the respective resonators with an electrical length of one-quarter wavelength of the C-band radiation (6 GHz). At 12 GHz, the resonators would have an electrical length of one-half wavelength, and render the filter 138 inoperative for transmission of radiation between the two waveguides 38 and 32 at the 12 GHz frequency. Thereby, by virtue of the operation of the filter 138, and by virtue of the short circuiting function of the back wall 70, the diplexer 14 is able to function with two signal bands which are an octave apart in frequency.

In summary, the operation of the diplexer 14 is as follows. The construction of the waveguide 38 with cross-sectional dimensions of 1.2 inch by 0.4 inch enables the impedance of the waveguide 38 to match the impedance, at Ku band, with the impedance of the waveguide 20 with an abrupt step for the transition at the opening 72 in the back wall 70. The step transition also acts as a short for the radiation of the waveguide 38 at 6 GHz because the waveguide 20 has a cut-off frequency at 7.87 GHz for the $TE_{10}$ mode of propagation. The step provided by the opening 72 in the back wall 70 for radiation at 6 GHz, in combination with the probe 128 which is also resonant at the 6 GHz, scatter some $TE_{11}$ and $TM_{11}$ modes which are attenuated by 26 dB (decibels) per inch at the highest frequency of 14.5 GHz, and by an attenuation of 68 dB at the front port 16. The $TE_{20}$ mode cut-off frequency is 9.83 GHz, but is not scattered because of the symmetry of the diplexer 14. Thereby, an antenna radiation pattern of the horn 12 is not affected by any of the higher order modes.

The two-pole filter 138 is a bandpass filter which is doubly terminated, and is maximally flat. The resonators of the shafts 112 and 124 are quarter wavelength TEM type inductively coupled. The resonators resonate at 6 GHz, and also at odd harmonics of 6 GHz, such as 18 GHz, resulting in a spurious passband at the frequency of 18 GHz. However, in the foregoing example of the communication system 10, there are no Ku-band signals at the frequency of 18 GHz so that the spurious passband of the filter 138 at this frequency does not interfere with operation of the diplexer 14.

The design bandwidth of the filter 138 at 3 dB is 1.5 GHz. This is wide enough to provide negligible transmission loss in the receiving band, but narrow enough so that the probe 128 coupled into the waveguide 38 causes no more than a negligibly small reflection at the signal frequencies of 12 GHz and 14 GHz. This reflection and that of the waveguide step at the back wall 70 are effectively tuned out by the pair of rods 74.

With respect to the manufacture of the diplexer 14, it is preferable to secure the support plate 114 to the abutment 118 by means of solder in addition to the use of the screw 116. The soldering procedure ensures a well defined path for currents flowing within the microwave circuit to prevent generation of passive intermodulation products. Also, the cover 82 provides a further convenience in the manufacture of the diplexer 14 by serving as a portion of the outer conductor 36 of the waveguide 32. The cover 82 is secured by bolts 140 (FIG. 3) to threaded sockets 142 (FIG. 2) arranged in a boss 144 located on the waveguide wall 42, the boss 144 and the array of sockets 142 encircling the waveguide 32. The bolts 140 pass through apertures 146 (FIG. 7) along the perimeter of the cover 82. The sidewalls 80A and 80B of the waveguide 32 are provided with a groove 148 (FIG. 2) for receiving a gasket (not shown), the gasket being fabricated typically of rubber with embedded silver particles. The gasket provides a seal against leakage of electromagnetic radiation along the interface 83 (FIG. 3) between the cover 82 and the sidewalls 80A and 80B of the waveguide 32.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A diplexer having a front port and a back port and a side port for communicating a first spectral region of electromagnetic power between said front port and said side port and a second spectral region of electromagnetic power between said front port and said back port, wherein a center frequency of said second spectral region is greater than a center frequency of said first spectral region by a factor greater than or equal approximately to two, the diplexer comprising:

a first waveguide and a second waveguide each having a rectangular cross section and supporting a transverse electric mode of electromagnetic wave, said first waveguide having a cut-off frequency below said first spectral region, said second waveguide having a cut-off frequency below said second spectral region and above said first spectral region;

a back wall terminating said first waveguide, said back wall having an opening through which said second waveguide extends for communicating with said first waveguide, said opening having cross sectional dimensions smaller than corresponding cross sectional dimensions of said first waveguide, said opening serving as said back port, said back wall serving as a shorting element to inhibit propagation of radiation at said first spectral region into said second waveguide, an end of said first waveguide opposite said back wall serving as said front port; and wherein said side port comprises an aperture disposed in a sidewall of said first waveguide, a third waveguide, and a coupling element extending from said third waveguide through said aperture into said first waveguide for coupling electromagnetic power at said first spectral region between said first and said third waveguides; and tuning means disposed within said third waveguide for inhibiting propagation of electromagnetic power at said second spectral region between said first and said third waveguides.

2. A diplexer according to claim 1 wherein said third waveguide is a coaxial transmission line having an inner conductor and an outer conductor encircling said inner conductor for supporting a transverse electromagnetic mode of electromagnetic wave.

3. A diplexer according to claim 2 wherein said coupling element is a probe oriented perpendicular to said inner conductor, and said tuning means is connected between said probe and said inner conductor.

4. A diplexer according to claim 3 wherein said tuning means is a band pass filter which passes said first spectral region and attenuates said second spectral region.

5. A diplexer according to claim 4 wherein said filter comprises a first resonator which is the said probe disposed perpendicularly with said inner conductor, and a second elongated resonator disposed coaxially with said inner conductor, said two resonators being inductively coupled.

6. A diplexer according to claim 5 wherein, in said coaxial transmission line, said outer conductor has a square cross section, at least a portion of said inner conductor lying in a plane parallel to an axis of said first waveguide.

7. A diplexer according to claim 6 further comprising a conductive plate extending within said coaxial transmission line from said outer conductor to a junction between said resonators, said plate serving to determine an amount of the inductive coupling between said resonators and to determine a coupling coefficient of said filter.

8. A diplexer according to claim 5 further comprising a capacitor interconnecting said second resonator of said filter with a portion of said inner conductor.

9. A diplexer according to claim 8 wherein plate elements of said capacitor are configured as cylindrical sections spaced apart from each other across a gap of said capacitor and are arranged coaxially along the axis of said inner conductor.

10. A diplexer according to claim 9 wherein said cylindrical sections have annular end surfaces facing each other across said gap.

11. A diplexer according to claim 9 further comprising a tuning ring slidably positioned along one of said cylindrical sections of said capacitor.

12. A diplexer according to claim 9 further comprising a tuning ring slidably positioned along one of said resonators for tuning said resonator.

13. A diplexer according to claim 9 further comprising a pair of tuning rings slidably positioned along respective ones of said cylindrical sections of said capacitor for adjusting capacitance of said capacitor.

14. A diplexer according to claim 13 wherein said capacitor comprises an insulating bushing of dielectric material disposed in said gap contiguous with end faces of said cylindrical sections of said capacitor.

15. A diplexer according to claim 14 wherein one of said resonators coincides with one of said cylindrical sections of said capacitor to permit a sliding of one of said tuning rings along both said one cylindrical section and said one resonator.

16. A diplexer according to claim 15 wherein said coaxial transmission line further comprises dielectric spacers disposed between said inner and said outer conductor for positioning said inner conductor within said outer conductor, and means connecting with said outer conductor for tightening said spacers against said inner and said outer conductors.

17. A diplexer according to claim 16 wherein, in said coaxial transmission line, said outer conductor has a square cross section, at least a portion of said inner conductor lying in a plane parallel to an axis of said first waveguide, and wherein said tightening means comprises screws mounted to an outer wall region of said third waveguide.

18. A diplexer according to claim 2 wherein said coaxial transmission line further comprises dielectric spacers disposed between said inner and said outer conductor for positioning said inner conductor within said outer conductor, and means connecting with said outer conductor for tightening said spacers against said inner and said outer conductors.

19. A diplexer according to claim 18 wherein, in said coaxial transmission line, said outer conductor has a square cross section, at least a portion of said inner conductor lying in a plane parallel to an axis of said first waveguide, and wherein said tightening means comprises screws mounted to an outer wall region of said third waveguide.

* * * * *